US007214463B2

(12) United States Patent
Patel et al.

(10) Patent No.: US 7,214,463 B2
(45) **Date of Patent: *May 8, 2007**

(54) TONER PROCESSES

(75) Inventors: Raj D. Patel, Oakville (CA); Karen A. Moffat, Brantford (CA); Fatima M. Mayer, Mississauga (CA); Allan K. Chen, Oakville (CA)

(73) Assignee: Xerox Corporation, Stamford, CT (US)

( * ) Notice: Subject to any disclaimer, the term of this patent is extended or adjusted under 35 U.S.C. 154(b) by 169 days.

This patent is subject to a terminal disclaimer.

(21) Appl. No.: 11/044,456

(22) Filed: Jan. 27, 2005

(65) Prior Publication Data

US 2006/0166122 A1 Jul. 27, 2006

(51) Int. Cl.
*G03G 9/087* (2006.01)

(52) U.S. Cl. ..... 430/137.14; 430/137.16

(58) Field of Classification Search ..... 430/137.14, 430/137.16

See application file for complete search history.

(56) References Cited

U.S. PATENT DOCUMENTS

| | | | | |
|---|---|---|---|---|
| 3,998,160 | A | 12/1976 | Pearce | 101/426 |
| 4,128,202 | A | 12/1978 | Buros | 235/493 |
| 4,517,268 | A | 5/1985 | Gruber et al. | 430/39 |
| 5,346,797 | A | 9/1994 | Kmiercik-Lawrynowicz et al. | 430/137 |
| 5,780,190 | A | 7/1998 | Listigovers et al. | 430/39 |
| 5,869,215 | A | 2/1999 | Ong et al. | 430/137 |
| 5,914,209 | A | 6/1999 | Grushkin | 430/106.6 |
| 6,132,924 | A | 10/2000 | Patel et al. | 430/137 |
| 6,268,102 | B1 | 7/2001 | Hopper et al. | 430/137.14 |
| 6,416,920 | B1 | 7/2002 | Hopper et al. | 430/137.14 |
| 6,472,117 | B1 * | 10/2002 | Kohyama et al. | 430/110.3 |
| 6,495,302 | B1 | 12/2002 | Jiang et al. | 430/137.14 |
| 6,500,597 | B1 | 12/2002 | Patel et al. | 430/137.14 |
| 6,541,175 | B1 | 4/2003 | Jiang et al. | 430/137.14 |
| 6,576,389 | B2 | 6/2003 | Vanbesien et al. | 430/137.14 |
| 6,617,092 | B1 | 9/2003 | Patel et al. | 430/137.14 |
| 6,627,373 | B1 | 9/2003 | Patel et al. | 430/137.14 |
| 6,656,657 | B2 | 12/2003 | Patel et al. | 430/137.14 |
| 6,656,658 | B2 | 12/2003 | Patel et al. | 430/137.14 |
| 6,767,684 | B1 | 7/2004 | Patel et al. | 430/137.14 |
| 6,830,860 | B2 | 12/2004 | Sacripante et al. | 430/109.3 |
| 6,936,396 | B2 * | 8/2005 | Patel | 430/137.14 |
| 6,942,954 | B2 * | 9/2005 | Patel et al. | 430/137.1 |
| 2003/0180647 | A1 * | 9/2003 | Patel et al. | 430/137.14 |
| 2003/0180648 | A1 | 9/2003 | Patel et al. | 430/137.14 |
| 2003/0180649 | A1 * | 9/2003 | Patel et al. | 430/137.14 |
| 2003/0180650 | A1 * | 9/2003 | Patel et al. | 430/137.14 |
| 2003/0180651 | A1 * | 9/2003 | Patel et al. | 430/137.14 |
| 2004/0265727 | A1 | 12/2004 | Vanbesien et al. | |
| 2004/0265728 | A1 * | 12/2004 | Patel et al. | 430/137.1 |
| 2004/0265729 | A1 * | 12/2004 | Patel | 430/137.14 |
| 2006/0166121 | A1 * | 7/2006 | Patel et al. | 430/109.4 |
| 2006/0172220 | A1 * | 8/2006 | Patel et al. | 430/137.14 |

OTHER PUBLICATIONS

Michael A. Hopper et al., U.S. Appl. No. 10/606,298, filed Jun. 25, 2003 on Toner Processes.

* cited by examiner

*Primary Examiner*—Hoa Van Le
(74) *Attorney, Agent, or Firm*—Eugene O. Palazzo; Fay Sharpe LLP

(57) ABSTRACT

A toner process comprised of a first heating of a mixture of an acicular magnetite dispersion, a colorant dispersion, a wax dispersion, and a core latex comprised of a first latex containing a vinyl crystalline polyester resin substantially free of crosslinking, and wherein said polyester is substantially dissolved in a vinyl monomer and polymerized to provide said first core latex resin, and which mixture contains a second crosslinked resin containing latex wherein said heating is accomplished in the presence of a coagulant to provide aggregates; adding a shell latex comprised of a polymer substantially free of crosslinking, and further heating said aggregates to provide coalesced toner particles, and wherein said further heating is at a higher temperature than said first heating.

24 Claims, No Drawings

TONER PROCESSES

CROSS-REFERENCE TO RELATED APPLICATIONS

Illustrated in copending application U.S. Ser. No. 10/606,330, filed Jun. 25, 2003, the disclosure of which is totally incorporated herein by reference, is a toner process comprised of heating a mixture of an acicular magnetite dispersion, a colorant dispersion, a wax dispersion, a first latex containing a crosslinked resin, and a second latex containing a resin free of crosslinking in the presence of a coagulant to provide aggregates, stabilizing the aggregates with a silicate salt dissolved in a base, and further heating the aggregates to provide coalesced toner particles.

Illustrated in copending application U.S. Ser. No. 10/606,298, filed Jun. 25, 2003, the disclosure of which is totally incorporated herein by reference, is a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein the first heating is below about the latex polymer glass transition temperature (Tg), and the second heating is about above the latex polymer glass transition temperature.

Illustrated in copending application U.S. Ser. No. 10/603,449, filed Jun. 25, 2003, the disclosure of which is totally incorporated herein by reference, is a toner process comprised of a first heating of a colorant dispersion, a latex emulsion, and a wax dispersion in the presence of a coagulant containing a metal ion; adding a complexing compound salt; followed by a second heating.

Illustrated in copending application U.S. Ser. No. 10/603,321, filed Jun. 25, 2003, the disclosure of which is totally incorporated herein by reference, is a toner process comprised of heating a mixture of an acicular magnetite dispersion, a colorant dispersion, a wax dispersion, a first latex containing a crosslinked resin, a second latex containing a resin substantially free of crosslinking, a coagulant and a complexing compound, and wherein the toner resulting possesses a shape factor of from about 120 to about 150.

Illustrated in copending application U.S. Ser. No. 10/106,473, Publication No. 20030180648, on Toner Processes, filed Mar. 25, 2002, the disclosure of which is totally incorporated herein by reference, is a process for the preparation of a toner comprising mixing a colorant dispersion comprising an acicular magnetite dispersion and a carbon black dispersion with a latex, a wax dispersion and a coagulant.

The appropriate components, such as for example, magnetites, waxes, coagulants, resin latexes, surfactants, and colorants, and processes of the above copending applications may be selected for the present invention in embodiments thereof.

BACKGROUND

Disclosed herein are toner processes, and more specifically, aggregation and coalescence toner processes. More specifically, illustrated herein in embodiments are methods for the preparation of toner compositions by a chemical process, such as emulsion/aggregation/coalescence, wherein a number of latex particles and wherein one of the latexes contains the in situ incorporation of a polyester, especially a crystalline polyester into a vinyl monomer like a styrene butylacrylate acrylic acid (V-CPE). In embodiments the latexes are heated in the presence of colorants, magnetites, waxes, charge additives, know toner additives, and thereafter there is added to the toner obtained surface additives. More specifically, disclosed are methods for the preparation of MICR toner compositions by a chemical process, such as emulsion/aggregation/coalescence, wherein there is aggregated with a wax and a core latex comprised of latexes, magnetite, and a colorant, and wherein one of the core latexes is a V-CPE resin and a second core latex is comprised of a crosslinked gel wherein the gel or crosslinking value is, for example, from about 20 to about 55 percent as measured gravimetrically in the presence of a coagulant like a polymetal halide, or alternatively a mixture of coagulants or flocculating agents; thereafter stabilizing the aggregates with a solution of a silicate like sodium silicate dissolved in a base, such as sodium hydroxide, or an organic complexing compound, and adding a vinyl shell polymer, and thereafter coalescing or fusing by heating the mixture above the core latex resin Tg to provide toner size particles which when developed by an electrographic process generates documents suitable for magnetic image character.

A number of advantages are associated with the toners and toner processes illustrated herein, such as excellent melt fusing temperatures of, for example, an about 20° C. decrease as compared to a number of similar known toners; lower minimum fixing temperatures characteristics, such as from about 15° C. to about 35° C., relative to a reference toner which contains no crystalline polyester (CPE), wherein the reference toners comprise a core of vinyl polymer and a crosslinked vinyl polymer, and a shell is comprised of a vinyl polymer, a noncrosslinked styrene, butylacrylate beta CEA resin, magnetite, carbon black, a wax and a cross linked resin of styrene, butylacrylate beta CEA resin and divinyl benzene in the amounts of 57:25:4.5:8.5:5 percent, respectively; a toner with excellent hot toner offset of, for example, about 210° C., and a fusing latitude of from about 40° C. to about 65° C., wherein fusing latitude refers, for example, to a temperature in which, when a developed image is fused, evidences substantially no offset either to the substrate that the image is fused on, referred to as "Cold" offset or offset on the fuser roll referred as the "Hot" offset; a toner minimum fixing temperature (MFT) of about 140° C. to about 180° C. to thereby extending photoreceptor life; lower fixing temperatures, acceptable rub resistance and excellent document offset, where lower fixing temperature is, for example, the temperature at which the toner image melts and fixes to the paper. Toner offset refers in embodiments to, for example, the image offsetting on paper or the vinyl where on a scale of 1 to 5, 5 refers to an image having no offset issues. Rub resistance in embodiments refers, for example, to when the toner is passed about ten times through a check reader and less than about one percent of the toner is removed from the image.

REFERENCES

Illustrated in U.S. Pat. No. 6,617,092, the disclosure of which is totally incorporated herein by reference, is a process for the preparation of a magnetic toner comprising heating a colorant dispersion containing acicular magnetite, a carbon black dispersion, a latex emulsion, and a wax dispersion.

Illustrated in U.S. Pat. No. 6,830,860, the disclosure of which is totally incorporated herein by reference, is a toner and emulsion/aggregation processes thereof, and which toner comprised of a branched amorphous resin, a crystalline resin, and a colorant Illustrated in U.S. Pat. No. 6,627,373, the disclosure of which is totally incorporated herein by reference, is a process for the preparation of a magnetic toner comprising the heating of a colorant dispersion comprised of a magnetite dispersion, and a carbon black dispersion, and thereafter mixing with a basic cationic latex emulsion and a wax dispersion.

Illustrated in U.S. Pat. No. 6,541,175, the disclosure of which is totally incorporated herein by reference, is a process comprising:

(i) providing or generating an emulsion latex comprised of sodio sulfonated polyester resin particles by heating the particles in water at a temperature of from about 65° C. to about 90° C.;

(ii) adding with shearing to the latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Illustrated in U.S. Pat. No. 6,656,658, the disclosure of which is totally incorporated herein by reference, is a toner process comprising heating a mixture of an acidified dispersion of an acicular magnetite with a colorant dispersion of carbon black, a wax dispersion, and an acidic latex emulsion.

Illustrated in U.S. Pat. No. 6,656,657, the disclosure of which is totally incorporated herein by reference, is a toner process comprising heating an acidified dispersion of an acicular magnetite with an anionic latex, an anionic carbon black dispersion, and an anionic wax dispersion.

Illustrated in U.S. Pat. No. 6,495,302, the disclosure of which is totally incorporated herein by reference, is a process for the preparation of toner comprising (i) generating a latex emulsion of resin, water, and an ionic surfactant, and a colorant dispersion of a colorant, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

Illustrated in U.S. Pat. No. 6,500,597, the disclosure of which is totally incorporated herein by reference, is a process comprising (i) blending a colorant dispersion of a colorant, water, and an anionic surfactant, or a nonionic surfactant with (ii) a latex emulsion comprised of resin, water, and an ionic surfactant;

(iii) adding to the resulting blend a first coagulant of a polyaluminum sulfo complexing compound (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Illustrated in U.S. Pat. No. 6,767,684, the disclosure of which is totally incorporated herein by reference, is a toner process comprising mixing a colorant dispersion comprising an acicular magnetite dispersion and a colorant with a latex containing a crosslinked resin, a latex containing a resin free of crosslinking, a wax dispersion, a resin, and a coagulant.

In U.S. Pat. No. 6,132,924, the disclosure of which is totally incorporated herein by reference, there is illustrated a process for the preparation of toner comprising mixing a colorant, a latex, and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant, a latex, and a coagulant, followed by aggregation and coalescence, wherein the coagulant may be a polyaluminum sulfosilicate.

Also, in U.S. Pat. No. 6,416,920, the disclosure of which is totally incorporated herein by reference, there is illustrated a process for the preparation of toner comprising mixing a colorant, a latex, and a silica, which silica is coated with an aluminates.

Magnetic ink printing methods with inks containing magnetic particles are known. For example, there is disclosed in U.S. Pat. No. 3,998,160, the disclosure of which is totally incorporated herein by reference, that various magnetic inks have been used in printing digits, characters, or artistic designs on checks or bank notes. The magnetic ink used for these processes can contain, for example, magnetic particles, such as a magnetite in a fluid medium, and a magnetic coating of ferric oxide, chromium dioxide, or similar materials dispersed in a vehicle comprising binders, and plasticizers.

Disclosed in U.S. Pat. No. 4,128,202, the disclosure of which is totally incorporated herein by reference, is a device for transporting a document that has been mutilated or erroneously encoded, and wherein there is provided a predetermined area for the receipt of correctly encoded magnetic image character recognition information (MICR). As indicated in this patent, the information is referred to as MICR characters, which characters can appear, for example, at the bottom of personal checks as printed numbers and symbols. These checks have been printed in an ink containing magnetizable particles therein, and when the information contained on the document is to be read, the document is passed through a sorter/reader which first magnetizes the magnetizable particles, and subsequently detects a magnetic field of the symbols resulting from the magnetic retentivity of the ink. The characters and symbols involved, according to the '202 patent, are generally segregated into three separate fields, the first field being termed a transient field, which contains the appropriate symbols and characters to identify the bank, bank branch, or the issuing source.

In U.S. Pat. No. 5,914,209, the disclosure of which is totally incorporated by reference, there is illustrated a process for preparing MICR toners using a combination of hard and soft magnetites, and a lubricating wax and melt mixing with a resin followed by jetting and classifying the blend to provide toner compositions.

In U.S. Pat. No. 4,517,268, the disclosure of which is totally incorporated by reference, there is illustrated a process for preparing MICR toners using styrene copolymers, such as styrene butadiene, by melt mixing in a Banbury apparatus, followed by pulverizing the magnetite and the resin, followed by jetting and classifying to provide, for example, 10 to 12 micron toner size particles which when mixed with an additive package and a carrier provides a developer suitable for use in the Xerox Corporation 9700®.

Further patents relating to MICR processes are U.S. Pat. Nos. 4,859,550; 5,510,221; and 5,034,298, illustrating, for example, the generation of MICR toners by conventional means such as that described in U.S. Pat. No. 4,517,268.

In a number of applications requiring MICR capabilities, the toners selected usually contain magnetites having specific properties, an important one of which is a high enough level of remanence or retentivity. Retentivity is a measure of the magnetism left when the magnetite is removed from the magnetic field, that is, the residual magnetism. Also of value are toners with a high enough retentivity such that when the characters are read, the magnetites produce a signal strength of equal to greater than about 100 percent. The signal level can vary in proportion to the amount of toner deposited on the document being generated, and signal strength of a toner composition can be measured by using known devices, including the MICR-Mate 1, manufactured by Checkmate Electronics, Inc.

In U.S. Pat. No. 5,780,190, the disclosure of which is totally incorporated herein by reference, there is disclosed an ionographic process which comprises the generation of a latent image comprised of characters; developing the image with an encapsulated magnetic toner comprised of a core comprised of a polymer and a soft magnetite, and wherein the core is encapsulated within a polymeric shell; and subsequently providing the developed image with magnetic ink characters thereon to a reader/sorter device.

Illustrated in U.S. Pat. No. 6,576,389, the disclosure of which is totally incorporated herein by reference, is a process for the preparation of toner comprising mixing a colorant dispersion, a latex emulsion, a wax dispersion and coagulants comprising a colloidal aluminate coated a complexing compound, and a polymetal halide.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. 6,617,092, 6,627,373, 6,656,657, 6,656,658, 6,673,505, and 6,767,684. The components and processes of these Xerox patents can be selected for the toners and processes disclosed herein.

In addition, the following U.S. Patents relate to emulsion aggregation toner processes.

U.S. Pat. No. 5,922,501, the disclosure of which is totally incorporated herein by reference, illustrates a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245, the disclosure of which is totally incorporated herein by reference, illustrates a surfactant free process for the preparation of toner comprising heating a mixture of an emulsion latex, a colorant, and an organic complexing agent.

SUMMARY

Disclosed is a toner with a number of the advantages illustrated herein, and more specifically, a toner containing a silica coated magnetite for Magnetic Ink Character Recognition (MICR) processes by, for example, selecting at least three dissimilar latexes, colorants, and specific magnetites that provide an acceptable readability signal by a check reader, and wherein the resulting toners possess a sufficient magnetic signal, desirable reduced melt fusing properties, excellent hot offset, and wider fusing latitude temperatures, and which toners contain, for example, a wax, colorant, a gel, or a crosslinked resin, a vinyl crystalline polyester resin (V-CPE), that is the polyester resin is dissolved in a vinyl monomer and then copolymerized with the vinyl monomer to form the V-CPE resin, and thereover a vinyl polymer shell, and wherein the V:CPE ratio is from about 80:20 to about 90:10.

Also, disclosed are processes for the preparation of a MICR toner wherein three dissimilar resins, pigment, magnetite, and wax are aggregated in the presence of a coagulant, such as polymetal halides or polymetal sulfosilicates, to provide toner size aggregates which can then be stabilized, for example with substantially no increase in size, by introducing a silicate salt or organic complexing compound in the presence of a base and further heating to provide toners with narrow particle size distribution.

Aspects of the present disclosure relate to a toner process comprised of a first heating of a mixture of an acicular magnetite dispersion, a colorant dispersion, a wax dispersion, and a core latex comprised of a first latex containing a vinyl crystalline polyester resin substantially free of crosslinking, and wherein the polyester is substantially dissolved in a vinyl monomer and polymerized to provide the first core latex resin, and which mixture contains a second crosslinked resin containing latex wherein the heating is accomplished in the presence of a coagulant to provide aggregates; adding a shell latex comprised of a polymer substantially free of crosslinking, and further heating the aggregates to provide coalesced toner particles, and wherein the further heating is at a higher temperature than the first heating; a process wherein the aggregates are mixed with an organic complexing compound or a silicate salt and a base; a process wherein the silica is incorporated in the toner by an in situ method, wherein the silica is obtained from the silicate, and wherein the silicate is selected in an amount of from about 0.5 to about 5 percent by weight of toner; a process comprising (i) heating the acicular magnetite dispersion containing water and an anionic surfactant, and the colorant dispersion containing carbon black, water, and an anionic surfactant, and optionally a nonionic surfactant, and wherein the wax dispersion is comprised of submicron wax particles of from about 0.1 to about 0.5 micron in diameter by volume, and which wax is dispersed in water and contains an anionic surfactant to provide a mixture containing magnetite, colorant, and a wax;

(ii) and wherein the resulting mixture is blended with the core latexes, the first latex comprising submicron non-crosslinked resin particles of about 150 to about 300 nanometers in diameter containing water, and an anionic surfactant or a nonionic surfactant, and wherein the second latex comprises submicron crosslinked resin particles of about 30 to about 150 nanometers in diameter and present in an amount of from about 10 to about 25 percent by weight, and containing water and an anionic surfactant or a nonionic surfactant; and the third latex is comprised of a vinyl copolymer;

(iii) wherein the resulting blend of (ii) possesses a pH of about 2.2 to about 2.8, and to which is added a coagulant to initiate flocculation or aggregation of the resulting components;

(iv) heating the resulting mixture of (iii) below about the glass transition temperature (Tg) of the vinyl crystalline resin to form aggregates;

(v) adding to the formed aggregates the third latex suspended in an aqueous phase containing an ionic surfactant and water;

(vi) adding to the resulting mixture of (v) an aqueous solution of a silicate salt dissolved in a base to thereby change the pH, which is initially from about 2 to about 2.8, to arrive at a pH of from about 7 to about 7.4 resulting in a coating of silica on the aggregate particles containing magnetite;

(vii) heating the resulting mixture of (vi) above the Tg of the vinyl crystalline polyester resin copolymer, and allowing the pH to decrease;

(viii) optionally retaining the mixture of (vii) at a temperature of from about 85° C. to about 95° C. for an optional period of about 10 to about 60 minutes, followed by a pH reduction with an acid to arrive at a pH of from about 4.2 to about 4.8, which pH is below about the Pzc of the magnetite particles wherein the Pzc is the pH of the mixture particles when the particles are free of a positive or a negative charge, and optionally wherein an increase in temperature results in a decreased Pzc value;

(ix) retaining the mixture temperature at from about 85° C. to about 95° C. for an optional period of about 5 to about 10 hours to assist in permitting the fusion or coalescence of the toner aggregates and to obtain smooth particles;

(x) washing the resulting toner slurry;

(xi) isolating the formed toner particles, and drying; and wherein the toner possesses a low melting temperature of from about 140° C. to about 170° C.; a process wherein the silicate salt dissolved in the base is introduced at (vi); a process wherein the silicate reacts with the magnetite rendering the magnetites substantially insensitive to pH fluctuations and resulting in the magnetite Point of Zero Charge (Pzc) being substantially ineffective; a process wherein the Pzc of the magnetite is altered by the silica, which silica is present as a coating on the magnetite, and wherein the silica is obtained from the silicate, and wherein the silicate is a sodium silicate, a potassium silicate, or a magnesium silicate sulfate, and the coagulant is a polymetal halide; a process wherein the pH is decreased to about 4.5, the pH being lower than that of the magnetite which is at a pH of about 5.3; a process wherein the silicate and the base are respectfully sodium silicate dissolved in sodium hydroxide, or potassium silicate ($K_2O/SiO_2$) dissolved in potassium hydroxide; a process wherein the silicate is sodium silicate, thereby forming $SiO_2$:$Na_2O$ with a weight ratio of about 1.6 to about 3.2; a process wherein the coagulant is selected from the group consisting of polyaluminum chloride (PAC), polyaluminum sulfosilicate (PASS), aluminum sulfate, zinc sulfate, and magnesium sulfate; a process wherein the colorant is carbon black, and optionally wherein the carbon black dispersion comprises carbon black particles of from about 0.01 to about 0.2 micron diameter dispersed in water and an anionic surfactant, and wherein the colorant is present in an amount of from about 4 to about 12 weight percent; a process wherein the amount of acicular magnetite selected is from about 20 to about 40 percent by weight of toner, the colorant is carbon black present in an amount of from about 4 to about 8 percent by weight of toner, and the wax is present in the amount of about 4 to about 12 percent by weight of toner; the crosslinked resin is present in the amount of about 5 to about 10 percent by weight; the resin free of crosslinking is present in an amount of about 30 to about 50 percent by weight of toner; the vinyl crystalline polyester resin is selected in an amount of from about 10 to about 20 percent by weight of toner; and the coagulant is comprised of polymetal halide present in an amount of about 0.02 to about 2 percent by weight of toner; a process wherein the acicular magnetite is from about 0.6 to about 0.1 micron in average volume diameter and is selected in an amount of from about 23 to about 35 percent by weight of toner, and wherein the coagulant is a polymetal halide selected in an amount of about 0.05 to about 0.15 percent by weight of toner; a process wherein the acicular magnetite possesses a coercivity of from about 250 to about 500 Oe, a remanent magnetization (Br) of about 23 to about 39 emu/gram, and a saturation magnetization (Bm) of about 70 to about 90 emu/gram, and wherein the toner exhibits a magnetic signal of about 90 to about 150 percent of the nominal where the nominal is a signal strength of about 100 percent; a process wherein the crosslinked resin contains particles of from about 0.15 to about 0.4 micron in volume average diameter, and the resin free of crosslinking is of a diameter of from about 0.15 to about 0.5 micron, and the third resin latex resin is of a volume average diameter of from about 0.15 to about 0.5 micron; a process wherein the acid is nitric, sulfuric, hydrochloric, citric or acetic acid, and the coagulant is a polyaluminum chloride wherein the shell is of a thickness of about 0.2 to about 0.8 micron, and optionally wherein the coagulant is a polymetal halide, and wherein the pH of the mixture resulting in (vi) is increased from about 2 to about 2.6 to about 7 to about 7.5, and wherein the silicate salt dissolved in a base functions primarily as a stabilizer for the aggregates during coalescence (vii), and no or minimal toner particle size increase results, and wherein the coagulant is a polymetal halide, and wherein the aggregation (iv) temperature is from about 45° C. to about 60° C., and wherein the coalescence or fusion temperature of (vii) and (viii) is from about 80° C. to about 95° C., and wherein the coagulant is a polyaluminum halide; and optionally, wherein the time of coalescence or fusion is from about 6 to about 12 hours; a process wherein the first latex resin is selected from the group comprised of copoly(styrene-alkyl acrylate crystalline polyester), or a copoly(styrene-1,3-diene-crystalline polyester); the second latex resin is comprised of a crosslinked vinyl polymer; and the noncrosslinked resin is poly(styrene-alkyl methacrylate), poly(alkyl methacrylate-alkyl acrylate), poly(alkyl methacrylate-aryl acrylate), poly (aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butadiene-acrylonitrile), and poly(styrene-butyl acrylate-acrylononitrile), or mixtures thereof; a process wherein the core polyester is comprised of a linear sulfonated polyester wherein the wax dispersion contains a polyethylene wax, a polypropylene wax or mixtures thereof, water, and an anionic surfactant; and wherein the wax is selected in an amount of from about 5 to about 20 weight percent wherein the vinyl crystalline polyester and the shell latex resin are free of crosslinking, and wherein the crosslinked resin is present in an amount of from about 2 to about 25 weight percent; and wherein the crosslinked resin possesses a molecular weight $M_W$ of from about 100,000 to about 1,000,000, and an onset glass transition (Tg) temperature of about 48° C. to about 58° C.; a process wherein the crosslinked resin is poly(styrene butylacrylate, beta carboxy ethyl acrylate divinyl benzene) wherein the shell resin free of crosslinking possesses a molecular weight $M_W$ of about 20,000 to about 500,000, and an onset glass transition (Tg) temperature of from about 45° C. to about 55° C., and wherein the polyester polymer is of a $M_W$ of from about 30,000 to about 40,000, and $M_n$ of from about 9,000 to about 13,000, and wherein the core contains the polyester formed by the polymerization of a crystalline polyester and a vinyl monomer; a process comprised of a first heating of a mixture of an acicular magnetite dispersion, a colorant dispersion, and a core comprised of a first latex comprised of a vinyl crystalline polyester copolymer, and a second latex containing a crosslinked resin in the presence of a coagulant; heating below the Tg of the first latex resin to provide aggregates; adding a shell latex comprised of a vinyl polymer free of crosslinking; adding a silicate salt dissolved in a base; and further heating at a temperature higher than the first heating to provide coalesced toner particles; a toner comprised of a colorant, magnetite, wax, a core comprised of a vinyl crystalline polyester copolymer and a crosslinked polymer, and a coating of a polymer free of crosslinking, optionally wherein the coating is comprised of a vinyl polymer free of crosslinking, and optionally wherein the vinyl polymer is a styrene butylacrylate beta carboxy ethylacrylate; a process wherein the vinyl core monomer is selected from the group comprised of styrene, butyl acrylate beta CEA styrene, butyl acrylate acrylic acid resin, styrene, butyl acrylate itaconic acid resin, styrene, butadiene acrylic acid resin, styrene, butadiene itaconic acid resin, and styrene, butadiene beta CEA resin, and wherein the crystalline polyester is a sulfonated polyester; a process wherein the organic complexing compound is selected in an amount of about 0.2 to about 5 pph by weight of toner, and is selected from the group consisting of ethylene diamine tetra acetic acid (EDTA), gluconal, sodium gluconate, potassium citrate, sodium citrate, a nitrotriacetate (NTA) salt, GLDA, the product of glutamic acid and N,N-diacetic acid; and humic acid, fulvic acid, maltol and ethylmaltol, peta-acetic and tetra-acetic acids, optionally wherein the silicate and the base are respectfully sodium silicate dissolved in sodium hydroxide, or potassium silicate ($K_2O/SiO_2$) dissolved in potassium hydroxide, and wherein the first latex resin is comprised of copoly(styrene butylacrylate beta carboxy ethylacrylate, crystalline polyester), the second crosslinked resin is comprised of poly(styrene butylacrylate beta carboxy ethylacrylate, divinyl benzene), and the shell is comprised of poly(styrene butylacrylate beta carboxy ethylacrylate; a developer comprised of the toner of presently presented and carrier particles; a process wherein the colorant is carbon black, the wax is an alkylene, and the coagulant is a polymetal halide; a process wherein the latex resin can be prepared by a starve feed method; a toner process comprised of heating a mixture of an acicular magnetite dispersion, a colorant dispersion, a wax dispersion in the presence of a coagulant to provide aggregates, followed by the addition of a third latex containing a resin substantially free of crosslinking to provide a shell or a coating on the formed aggregates, stabilizing the aggregates with, for example, an organic complexing compound like ethylene diamine tetra acetic acid (EDTA) or a silicate salt dissolved in a base, and further heating the aggregates to provide coalesced toner particles; a process comprising (i) mixing an acicular magnetite dispersion containing water and an anionic surfactant, a colorant dispersion containing carbon black, water, and an anionic surfactant, and optionally a nonionic surfactant, a wax dispersion comprised of submicron wax particles of from about 0.1 to about 0.5 micron in diameter by volume, and which wax is dispersed in water and contains an anionic surfactant to provide a mixture containing magnetite, colorant, and a wax;

(ii) wherein the resulting mixture is blended with a first and a second core latex, the first latex comprising, for example, a submicron V-CPE resin particle of about 150 to about 300 nanometers in diameter containing water, an anionic surfactant or a nonionic surfactant, and wherein the second latex comprises submicron crosslinked gel particles of about 30 to about 150 nanometers in diameter, and containing water and an anionic surfactant or a nonionic surfactant;

(iii) wherein the resulting blend of (ii) possesses a pH of about 2.2 to about 2.8, and to which is added a coagulant to initiate flocculation or aggregation of the resulting components;

(iv) heating the resulting mixture of (iii) below about the glass transition temperature (Tg) of the V-CPE resin free of crosslinking to form aggregates;

(v) adding to the formed aggregates a third latex comprised of a noncrosslinked resin suspended in an aqueous phase containing an ionic surfactant and water;

(vi) adding to the resulting mixture of (v) an aqueous solution of a silicate salt dissolved in a base to thereby change the pH, which is initially from about 2 to about 2.8, to arrive at a pH of from about 7 to about 7.4 resulting in a coating of silica on the aggregate particles containing magnetite;

(vii) heating the resulting mixture of (vi) about above the Tg of the V-CPE noncrosslinked resin of (i) and allowing the pH to decrease;

(viii) retaining the mixture of (vii) at a temperature of from about 85° C. to about 95° C. for an optional period of about 10 to about 60 minutes, followed by a pH reduction with an acid to arrive at a pH of from about 4.2 to about 4.8, which pH is below about the Pzc of the magnetite particles wherein the Pzc is the pH of the mixture particles when the particles are free of a positive or a negative charge, and optionally wherein an increase in temperature results in a decreased Pzc value;

(ix) retaining the mixture temperature at from about 85° C. to about 95° C. for an optional period of about 5 to about 10 hours to assist in permitting the fusion or coalescence of the toner aggregates and to obtain smooth particles;

(x) washing the resulting toner slurry;

(xi) isolating the formed toner particles, and drying; a toner process comprised of heating a mixture of a magnetite dispersion, a carbon black colorant dispersion, a wax, a first latex containing a crosslinked resin, and a second latex containing a V-CPE resin in the presence of a coagulant like a polymetal halide to provide aggregates, stabilizing the aggregates with a silicate salt dissolved in a base, adding a vinyl polymer shell, and further heating the aggregates to provide coalesced toner particles; a process comprising heating a mixture of magnetite, colorant, a first latex, and a second latex, and wherein the first latex contains a V-CPE resin, the second latex contains a crosslinked polymer, and there is added a third latex comprised of a noncrosslinked polymer, and subsequent to aggregation adding and after addition of the shell latex there is added a coagulant; the preparation of MICR toners wherein the toner comprises magnetite, three resins, wax, silica and crosslinked gel particles wherein the silica is introduced in the form of a silicate salt dissolved in sodium hydroxide, and which solution possesses a pH of about 12, and wherein silica binds or coats the magnetite or the aggregate particles containing the magnetite thereby allowing the pH during coalescence to be lowered below the Point of Zero Charge of the uncoated magnetite, for example equal to or less than about 5; a process wherein the coating of silica on the magnetite particles lowers the Pzc from a value of about 5.4 to about 3.5 enabling the pH during coalescence to be reduced to about 4 to about 5 without any toner size increase, thereby providing a broader process latitude and more rapid coalescence, which coalescence can be reduced by about 40 percent; a toner process wherein there is selected a silica in the form of a silicate salt present on oxide particles such as titanium, aluminum, zirconium and in particular magnetite which exhibit dual charge capabilities depending on the pH of the surrounding media, allowing these particles to function as coagulating/flocculating agents for an anionic or a cationic process, and wherein the addition of the silicate salt forms a coating of silica on the magnetite aggregates thereby reducing or lowering the Pzc, for example from about 5.3 to about 3.5; a toner process wherein the toner formed can be of various shapes, such as a potato like shape to spherical shape, by, for example, reducing the pH during coalescence below a pH of 5; a MICR toner containing the in situ incorporation of silica wherein the silica is introduced in the form of a silicate salt, which is dissolved in a base; a MICR toner containing silica and prepared by emulsion aggregation processes wherein the magnetite is in the form of needle shape or acicular magnetite particles, which are of a size diameter of, for example, from about 450 nanometers to about 700 nanometers; a toner process involving the silica incorporation by the introduction of an aqueous solution of a silicate salt dissolved in a base, which base is introduced into an aggregate mixture prior to increasing the temperature of the aggregate particles above the resin Tg to achieve coalescence or fusion; a toner process that is capable of incorporating into toners needle shape or acicular magnetites, which have a coercivity of about 350 oersteds (Oe), which is about 2 to about 3 times that of cubic or spherical magnetite, which have a coercivity of about 110 oersteds, to provide an adequate magnetic signal, for example greater then 100 percent, where 100 percent refers, for example, to the nominal signal for readability by a check reader; and the preparation of a MICR toner by emulsion aggregation processes wherein the amount of acicular magnetite loading is about 23 to about 35 weight percent of toner, or about 45 to about 65 weight percent to provide an adequate magnetic signal for readability by a check reader; a process wherein (i) the acicular magnetite dispersion contains water and an anionic surfactant, or a nonionic surfactant, the colorant dispersion of carbon black contains water and an anionic surfactant, or a nonionic surfactant, and the wax dispersion is comprised of submicron wax particles of from about 0.1 to about 0.5 micron in diameter by volume, and which wax is dispersed in water and an anionic surfactant to provide a mixture containing magnetite, colorant, and a wax;

(ii) wherein the mixture of (i) is blended with a latex emulsion comprised of submicron noncrosslinked resin particles in the size diameter range of about 150 to about 300 nanometers, and containing water, an anionic surfactant or a nonionic surfactant, and a second latex comprised of submicron crosslinked gel particles in the size diameter range of about 30 to about 150 nanometers containing water and an anionic surfactant or a nonionic surfactant; and a third latex containing a V-CPE resin, water, and surfactant to provide a blend of magnetite, colorant, wax and resins;

(iii) wherein the resulting blend possesses a pH of about 2.2 to about 2.8 to which is added a coagulant, such as a polymetal halide, to initiate flocculation or aggregation of the blend components;

(iv) heating the resulting mixture of (iii) below about the glass transition temperature (Tg) of the core latex V-CPE resin to form toner sized aggregates;

(v) adding to the formed toner aggregates a latex comprised of a noncrosslinked resin suspended in an aqueous phase containing an ionic surfactant and water, and stirring for a period of time to permit stabilization of the aggregate particle size;

(vi) adding to the resulting mixture of (v) an aqueous solution of a silicate salt dissolved in a base to thereby change the pH, which is initially from about 2 to about 2.8, to arrive at a pH of from about 7 to about 7.4, and allowing the mixture to stir for a period of about 5 to about 10 minutes to provide a coating of silica on the aggregate particles containing magnetite;

(vii) heating the resulting aggregate mixture of (vi) above about the Tg of the latex containing the noncrosslinked resin of (i);

(viii) retaining the mixture temperature at from about 85° C. to about 95° C. for an optional period of about 10 to about 60 minutes, followed by a pH reduction with an acid to arrive at a pH of about 4.2 to about 4.8, which pH is usually below the Pzc of the magnetite particles;

(ix) retaining the mixture temperature at from about 85° C. to about 95° C. for a period of about 5 to about 10 hours to assist in permitting the fusion or coalescence of the toner aggregates and to obtain smooth particles;

(x) washing the resulting toner slurry;

(xi) isolating the toner and drying; a process for the preparation of a MICR toner composition, which when analyzed for aluminum and silica contents contains about 70 to about 95 percent of both thereby providing a means of detection of how the toner was fabricated; a toner composition comprised of magnetite, a noncrosslinked latex, a crosslinked latex, a V-CPE resin, wax, carbon black and a silica which is incorporated during particle fabrication as a coating rather than an external additive; a process wherein the magnetite dispersion contains an anionic surfactant and a nonionic surfactant wherever the dispersion possesses a pH of from about 6.5 to about 6.8; a process wherein the carbon black dispersion comprises particles dispersed in water and an anionic surfactant, and which dispersion possesses a pH of about 6.3 to about 6.8; a process wherein the wax dispersion comprises particles dispersed in water and an ionic surfactant; a process wherein the acicular magnetite is present in an amount of from about 20 to about 35 percent by weight of toner, and preferably in an amount of from about 23 to about 32 percent by weight of toner; a process wherein the acicular magnetite utilized exhibits a coercivity of from about 250 to about 700 Oe; a process wherein the acicular magnetite has a particle size of about 0.6 micron in length by 0.1 micron in diameter, and is comprised of about 21 percent FeO and about 79 percent $Fe_2O_3$; a process wherein the toner exhibits a magnetic signal of from about 115 to about 150 percent of the nominal signal; a process wherein the toner possesses a minimum fix temperature (MFT) of about 140° C. to about 175° C.; a process wherein the toner hot offset temperature (HOT) is in excess of about 210° C.; a process wherein the magnetite dispersion is obtained by a ball milling, attrition, polytroning or media milling resulting in magnetite particles dispersed in water containing an anionic surfactant; a process wherein the carbon black dispersion is present in an amount of about 4 to about 8 percent by weight of toner; a process wherein the latex resin particles are from about 0.15 to about 0.3 micron in volume average diameter; a process wherein the magnetite is of a size of about 0.6 micron to about 0.1 micron, and the carbon black is of a size of about 0.01 to about 0.2 micron in average volume diameter; a process wherein the acid is selected from the group consisting of nitric, sulfuric, hydrochloric, citric and acetic acid; a process wherein the base is selected in the form of a silicate salt dissolved in the base, which silicate is selected from a group of sodium silicate or potassium silicate or magnesium sulfate silicate; a process wherein the addition of the silicate salt dissolved in the base is added to the toner size aggregates, which provides a coating of silica on the aggregates containing the magnetite or the iron oxide particles, rendering it substantially nonreactive, thus a toner process wherein the addition of a basic silicate salt provides a method to stabilize the toner size aggregates from further growth during coalescence, when the temperature of the aggregate mixture is raised above the V-CPE (vinyl crystalline-polyester copolymer) resin Tg; a process wherein there is added to the formed toner size aggregates a latex comprised of noncrosslinked submicron resin particles suspended in an aqueous phase containing an anionic surfactant, and wherein the noncrosslinked latex is selected in an amount of from about 10 to about 40 percent by weight of the initial latex to form a shell on the formed aggregates, and which shell is of a thickness of, for example, about 0.2 to about 0.8 micron; a process wherein the pH of the mixture resulting in (vi) is increased from about 2 to about 2.6 to about 7 to about 7.5 with the addition of sodium silicate dissolved in sodium hydroxide, which addition components function as a stabilizer for the aggregates when the temperature of the coalescence (vi) is raised above the resin Tg; a process wherein the addition of a basic sodium silicate provides a reaction with iron oxide or magnetite, thereby allowing the pH during coalescence (viii) to be reduced to less than 5 to provide MICR toners; a process wherein the temperature at which toner sized aggregates are formed controls the size of the aggregates, and wherein the final toner size is from about 5 to about 12 microns in volume average diameter; a process wherein the aggregation (iv) temperature is from about 45° C. to about 60° C., and wherein the coalescence or fusion temperature of, for example, (vii) and (viii) is from about 85° C. to about 95° C.; a process wherein the time of coalescence or fusion is from about 5 to about 10 hours, and wherein there are provided toner particles with a smooth morphology; a process wherein the shell or coating each comprises a noncrosslinked vinyl resin and the core is comprised of a V-CPE resin and a crosslinked resin; a toner process wherein latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly (styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein one of the latexes contains a resin selected from the group consisting of poly(styrene-butadiene), poly(methylstyrene-butadiene), poly(methyl methacrylate-butadiene), poly (ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); poly(styrene butyl acrylate beta carboxy ethyl acrylate (beta CEA), poly(styrene butadiene beta CEA), poly(styrene isoprene beta CEA), poly(styrene butyl acrylate, acrylonitrile beta CEA), poly(styrene butyl acrylate, divinylbenzene beta CEA), and more specifically, poly(styrene butyl acrylate beta CEA); a process for the preparation of a MICR toner comprising mixing (i) an acicular magnetite dispersion containing water and an anionic surfactant, and a colorant dispersion of carbon black containing water, an anionic surfactant, and a wax dispersion;

(ii) wherein the mixture of (i) is blended with two latex emulsions comprised of submicron noncrosslinked V-CPE resin particles in the size range of about 150 to about 275 nanometers and containing water, an anionic surfactant or a nonionic surfactant, a second latex containing crosslinked resin particles in the size range of about 30 to about 150 nanometers, and containing water and an anionic surfactant or a nonionic surfactant;

(iii) wherein the resulting blend possesses a pH of about 2.4 to about 2.7, and there is added a cationic coagulant of a polyaluminum chloride to initiate flocculation or aggregation of the components of (i) and (ii);

(iv) heating the resulting mixture of (iii) in the absence of the vinyl shell, below the glass transition temperature (Tg) of the crosslinked resin latex to form toner sized aggregates;

(v) adding to the formed toner aggregates a third latex comprised of a resin particles suspended in an aqueous phase containing an ionic surfactant and water, and stirring for a period of time to permit stabilization of the aggregate particle size;

(vi) adding to the resulting mixture of (v) an aqueous solution of a sodium silicate dissolved in sodium hydroxide to thereby change the pH, which is initially from about 2 to about 2.8, to arrive at a pH of from about 7 to about 7.4, and allowing the mixture to stir for a period of about 5 to about 15 minutes causing the silica to react with the magnetite particles;

(vii) heating the resulting aggregate suspension of (vi) above the Tg of the latex noncrosslinked resin of (i);

(viii) retaining the mixture temperature at from about 80° C. to about 95° C. for a period of about 10 to about 75 minutes, followed by a pH reduction with an acid to arrive at a pH of about 4.2 to about 4.8;

(ix) retaining the mixture temperature at from about 80° C. to about 95° C. for a period of about 5 to about 8 hours to assist in permitting the fusion or coalescence of the toner aggregates and to obtain smooth toner particles;

(x) washing the resulting toner slurry;

(xi) isolating the toner particles and drying in an oven;

(i) a toner process wherein there is selected a core latex, a magnetite dispersion that contains water and an anionic surfactant, a colorant dispersion which contains a black colorant, water and an anionic surfactant, and a wax dispersion comprised of submicron wax particles of from about 0.1 to about 0.9 micron in diameter by volume, and which wax is dispersed in an anionic surfactant;

(ii) wherein the core latex is comprised of two latex emulsions, a noncrosslinked latex, a V-CPE latex, a crosslinked latex, and wherein each of the latexes contain the resin particles illustrated herein, water and an anionic surfactant;

(iii) adding to the resulting mixture with a pH of about 2 to about 3, a coagulant, and which coagulant is a polymetal halide, a cationic surfactant, or mixtures thereof to primarily enable flocculation of the resin latexes, the magnetite, the colorant, and the wax;

(iv) heating the resulting mixture below about the glass transition temperature (Tg) of the vinyl latex resin to form toner sized aggregates;

(v) adding to the formed toner aggregates a latex comprised of noncrosslinked resin particles suspended in an aqueous phase containing an ionic surfactant and water;

(vi) adding to the resulting mixture of (v) an aqueous solution of a silicate dissolved in sodium hydroxide to thereby change the pH from an initial about 2 to about 2.9 to a pH of from about 7 to about 8;

(vii) heating the resulting aggregate suspension of (vi) to above the Tg of the vinyl latex resin of (i);

(viii) optionally retaining the mixture temperature at from about 70° C. to about 95° C. optionally for a period of about 25 to about 60 minutes, followed by a pH reduction with an acid to arrive at a pH of about 4 to about 5 to assist in permitting the fusion or coalescence of the toner aggregates;

(ix) further retaining the mixture temperature at from about 85° C. to about 95° C. for an optional period of about 4 to about 10 hours to assist in permitting the fusion or coalescence of the toner aggregates to obtain smooth particles; and (x) washing the resulting toner slurry; and isolating the toner; a process wherein the colorant dispersion contains an anionic surfactant; a process wherein the colorant is carbon black, and wherein the carbon black dispersion comprises carbon black particles dispersed in water and an anionic surfactant, and wherein the colorant is present in an amount of from about 4 to about 10 weight percent; a process wherein the amount of acicular magnetite selected is from about 20 to about 40 percent by weight of toner, and the coagulant is comprised of a first coagulant of a polymetal halide present in an amount of about 0.02 to about 2 percent by weight of toner, and a further second cationic surfactant coagulant present in an amount of about 0.1 to about 5 percent by weight of toner; a process wherein the amount of acicular magnetite selected is from about 23 to about 35 percent by weight of toner, and the amount of coagulant, which coagulant is a polymetal halide, is selected in an amount of about 0.05 to about 0.15 percent by weight of toner; a process wherein the acicular magnetite utilized exhibits a coercivity of from about 250 to about 700 Oe; a process wherein the acicular magnetite possesses a coercivity of from about 250 to about 500 Oe, a remanent magnetization (Br) of about 23 to about 39 emu/gram, and a saturation magnetization (Bm) of about 70 to about 90 emu/gram; a process wherein the toner exhibits a magnetic signal of about 90 to about 150 percent of the nominal where nominal is a signal strength of about 100 percent; a process wherein the toner possesses a minumum fix temperature (MFT) of about 140° C. to about 190° C.; a process wherein the toner hot offset temperature (HOT) is from about 210° C. to about 250° C.; a process wherein the magnetite dispersion is obtained by ball milling, attrition, polytroning or media milling with an anionic surfactant resulting in magnetite particles suspended in water containing the anionic surfactant; a process wherein the colorant is carbon black, and the amount of the carbon black dispersion is from about 3 to about 8 percent by weight of toner; a process wherein the crosslinked resin contains resin particles of from about 0.15 to about 0.4 micron in volume average diameter; a process wherein the magnetite size is from about 0.6 micron to about 0.1 micron in average volume diameter, and the colorant is carbon black, and the carbon black is from about 0.01 to about 0.4 micron in average volume diameter; a process wherein the acid is diluted or concentrated nitric, sulfuric, hydrochloric, citric or acetic acid, and the coagulant is comprised of a first coagulant of a polyaluminum chloride and a second coagulant of a cationic surfactant; a process wherein the base is introduced in the form of a silicate salt dissolved in a base selected from a group consisting of sodium silicate dissolved in sodium hydroxide, potassium silicate dissolved in potassium hydroxide, and wherein the noncrosslinked latex is selected in an amount of from about 10 to about 40 percent by weight of the initial latexes (i) to form a shell thereover on the formed aggregates, and which shell is of an optional thickness of about 0.1 to about 1 micron, and wherein the coagulant is a polymetal halide; a process wherein the temperature at which toner sized aggregates are formed controls the size of the aggregates, and wherein the final toner size is from about 3 to about 25 microns in volume average diameter; a process wherein the aggregation (iv) temperature is from about 40° C. to about 65° C., and wherein the coalescence or fusion temperature of (vii) and (viii) is from about 80° C. to about 95° C., and wherein the coagulant is a polyaluminum halide; a process wherein the time of coalescence or fusion is from about 4 to about 12 hours, and wherein the MICR toner resulting possesses a smooth morphology; a process wherein the shell latex or the core is comprised of a vinyl CPE wherein the vinyl monomer prior to polymerization is free of crosslinking, and which resin is selected from the group comprised of poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylon itrile), poly(alkyl acrylate-acrylon itrile), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylonitrile), and poly(styrene-butyl acrylate-acrylononitrile); a process wherein the crosslinked and noncrosslinked resin emulsions resin contains a carboxylic acid selected from the group comprised of acrylic acid, methacrylic acid, itaconic acid, beta carboxy ethyl acrylate, fumaric acid, maleic acid, cinnamic acid, and the like, and wherein the carboxylic acid is selected in an amount of from about 0.1 to about 10 weight percent; a process wherein a crosslinking component monomer, such as divinyl benzene, is added to the core resins, and wherein the monomer is selected in an amount of from about 0.5 to about 15 percent by weight to provide a crosslinked resin; a process wherein the vinyl-CPE resin is prepared by dissolving the CPE polymer into a monomer, preferably a styrene based monomer, and then copolymerizing with an acrylate monomer, such as butyl acrylate, and a carboxylic acid monomer, such as beta carboxy ethyl acrylate (beta CEA), by emulsion polymerization to provide a noncrosslinked latex; and a toner process wherein the coagulant is a polymetal halide; a process wherein there is optionally further included a second coagulant of a cationic surfactant coagulant; a process wherein the coagulant is polymetal halide of a polyaluminum chloride, a polyaluminum sulfosilicate, or a polyaluminum sulfate selected in an amount of about 0.05 to about 0.3 pph by weight of toner, and there optionally added to the mixture a second cationic surfactant coagulant of an alkylbenzyl dimethyl ammonium chloride in an amount, for example, of from about 0.1 to about 2 by weight of toner; a process wherein the wax dispersion contains a polyethylene wax, water, and an anionic surfactant, and wherein the wax is selected in an amount of from about 5 to about 20 weight percent; a process wherein the wax dispersion contains a polypropylene wax, water, and an anionic surfactant, and wherein the wax is selected in an amount of from about 5 to about 20 weight percent; a process wherein the optional second coagulant is selected from the group comprised of alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and cetyl pyridinium bromide present in an amount of about 0.1 to about 5 percent by weight of toner; a toner composition process wherein the acicular magnetite possesses a coercivity of about 250 to about 700 Oe, a particle size of about 0.6 micron in length×0.1 micron in diameter, a coercivity of from about 250 to about 500 Oe, a remanent magnetization (Br) of about 23 to about 39 emu/gram, and a saturation magnetization (Bm) of about 70 to about 90 emu/gram; a coercivity of about 345 Oe, a remanent magnetization (Br) of about 35 emu/gram, and a saturation magnetization (Bm) of about 85 emu/gram; a coercivity of about 370 Oe, a remanent magnetization (Br) of about 33 emu/gram, and a saturation magnetization (Bm) of about 83 emu/gram; a magnetite with a coercivity of about 270 Oe, a remanent magnetization (Br) of about 20 emu/gram, and a saturation magnetization (Bm) of about 79 emu/gram; a coercivity of from about 250 to about 400 Oe, a remanent magnetization (Br) of about 23 to about 55 emu/gram, and a saturation magnetization (Bm) of about 70 to about 90 emu/gram; and wherein the acicular magnetite is present in the toner in an amount of from about 15 to about 35 weight percent; a process wherein the acicular magnetite possesses a coercivity of about 350 to about 600 Oe, a particle size of about 0.7 micron in length×0.1 micron in diameter, a magnetite with a coercivity of from about 275 to about 500 Oe, a remanent magnetization (Br) of about 20 to about 40 emu/gram, and a saturation magnetization (Bm) of about 75 to about 90 emu/gram; and wherein the wax is a polyethylene, a polypropylene, or mixtures thereof; a process wherein the crosslinked resin is selected in an amount of from about 3 to about 35 weight percent; a process wherein the crosslinked resin is selected in an amount of from about 2 to about 25 weight percent; a process wherein the crosslinked resin is poly(styrene butylacrylate, beta carboxy ethyl acrylate divinyl benzene); a process wherein the resin free from crosslinking possesses a molecular weight $M_W$ of about 20,000 to about 500,000, and an onset glass transition (Tg) temperature of from about 45° C. to about 70° C.; a process wherein the crosslinked latex resin possesses a molecular weight $M_W$ of about 100,000 to about 1,000,000, and an onset glass transition (Tg) temperature of about 48° C. to about 58° C.; a process wherein the crosslinked resin latex is selected in an amount of from about 5 to about 12 weight percent, the V-CPE resin is selected in an amount of from about 5 to about 30 percent by weight (by weight throughout unless otherwise indicated), and more specifically, from about 5 to about 20 percent by weight of toner; a process wherein the noncrosslinked latex is selected in an amount of from about 30 to about 50 weight percent, and the crosslinked latex is selected in an amount of from about 5 to about 15 weight percent, and the third or shell latex resin, such as V-CPE, is selected in an amount of from about 10 to about 20 weight percent by weight of toner, wherein the toner also contains magnetite and a carbon black pigment; a toner wherein the magnetite is selected in an amount of from about 20 to about 35 weight percent, the wax is selected in an amount of from about 5 to about 15 weight percent, and wherein the total thereof is about 100 percent based on the toner; a process wherein the resulting toner possesses a shape factor of from about 110 to about 148; a process wherein the colorant dispersion contains colorant and an anionic surfactant; a process wherein colorant dispersion is comprised of carbon black particles dispersed in water and an anionic surfactant; a process wherein the amount of acicular magnetite selected is from about 25 to about 40 percent by weight of toner, and the coagulant is a polymetal halide present in an amount of about 0.05 to about 0.4 percent by weight of toner; a process where the coagulant is a cationic surfactant present in the amount of about 0.1 to about 2 percent by weight of toner; a process wherein the coagulant is comprised of a mixture of a polymetal halide and a cationic surfactant; a process wherein the amount of acicular magnetite selected is from about 23 to about 32 percent by weight of toner, and the amount of coagulant, which coagulant is a polymetal halide, is present in an amount of about 0.05 to about 0.13 percent by weight of toner and the optional cationic surfactant coagulant is present in an amount of about 0.15 to about 1.5 percent by weight of toner; a process wherein the noncrosslinked resin or polymer has a glass transition temperature (Tg) of about 45° C. to about 70° C.; a process wherein the noncrosslinked resin possesses a weight average molecular weight of about 30,000 to about 80,000; a process wherein the crosslinked latex contains a polymer, wherein the crosslinking percentage or value is, for example, from about 5 to about 50 percent, or about 10 to about 30 percent by weight of poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), and poly(styrene-butyl acrylate-acrylononitrile), and wherein the polymer in addition contains a crosslinking component, such as divinyl benzene (DVB), to enable the crosslinked resin or polymer, and wherein the crosslinking component can be selected in an amount of from about 0.05 to about 15 weight percent; a process wherein the polymer, in addition to DVB, can contain a carboxylic acid, and which carboxylic acid is, for example, selected from the group comprised of acrylic acid, methacrylic acid, itaconic acid, beta carboxy ethyl acrylate; and the like, and wherein the carboxylic acid is present in an amount of from about 0.5 to about 10 weight percent; a process comprising the heating of a magnetite dispersion, a colorant dispersion, at least three, for example from about three to about seven latexes, of a crosslinked polymer, wherein the crosslinking is, for example, from about 35 to about 75 percent, and coagulants, wherein one of the coagulants is a polyaluminum chloride, or bromide, and the optional second coagulant is a cationic surfactant, such as an alkylbenzyl dimethyl ammonium chloride, and wherein the mixture is aggregated by heating below the latex uncrosslinked resin glass transition temperature, followed by the addition of a silicate salt dissolved in a base, and thereafter, heating above the latex uncrosslinked resin glass transition temperature; a process wherein the aggregate mixture pH value is about 7 to about 7.7 obtained by the addition of a silicate salt dissolved in a base like sodium hydroxide; a process wherein the acicular magnetite, which can be comprised of 21 percent FeO and 79 percent $Fe_2O_3$, is selected from the group consisting of B2510, B2540, B2550, HDM-S 7111 with a coercivity of from about 350 to about 500 Oe and a remanent magnetization (Br) of about 25 to about 35 emu/gram, and a saturation magnetization (Bm) of about 75 to about 90 emu/gram, all available from Magnox; MR-BL with a coercivity of about 340 Oe, a remanent magnetization (Br) of about 37 emu/gram, and a saturation magnetization (Bm) of about 80 emu/gram, all available from Titan Kogyo and Columbia Chemicals; MTA-740 with a coercivity of about 375 Oe, a remanent magnetization (Br) of about 35 emu/gram, and a saturation magnetization (Bm) of about 83 emu/gram, and all available from Toda Kogyo Inc.; AC 5151M with a coercivity of about 270 Oe, a remanent magnetization (Br) of 20 emu/gram, and a saturation magnetization (Bm) of 79 emu/gram, available from Bayer Corporation; MO4232, MO4431 with a coercivity of from about 250 to about 400 Oe, a remanent magnetization (Br) of about 23 to about 60 emu/gram, and a saturation magnetization (Bm) of about 70 to about 90 emu/gram, available from Elementis Inc.; wherein the toner exhibits a magnetic signal of from about 125 to about 150 percent of the nominal signal where nominal signal refers to the signal strength of 100 percent, and wherein the acicular magnetite selected is present in the toner in an amount, for example, of from about 10 to about 35 weight percent, and more specifically, in an amount of about 22 to about 32 percent by weight of toner; a toner process as illustrated herein wherein the amount of resin free of crosslinking is from about 40 to about 65 weight percent, the amount of crosslinked resin is from about 2 to about 15 weight percent; the amount of magnetite is from about 20 to about 35 weight percent; the colorant amount is from about 4 to about 10 weight percent; and the wax amount is from about 5 to about 15 weight percent; and the total of the components is 100 percent; a process for preparing a chemical toner wherein the blending and aggregation are performed at a pH of about 2 to about 3 or about 2 to about 2.8, while the coalescence is initially conducted at a pH of about 7 to about 8 followed by a reduction in pH to about 5.5 to about 6.5, and followed by further heating for a period of hours, for example, about 6 to about 12 hours; and a process for preparing a MICR toner composition by emulsion aggregation, which toner possesses a smooth shape and a toner particle size distribution of about 1.20 to about 1.26, and which toner provides a MICR signal of about 90 to about 140 percent, and a bulk remanence of about 26 emu/gram wherein the remanence can be measured on a tapped powder magnetite sample in a cell of 1 centimeter×1 centimeter×about 4 centimeters. The sample is magnetized between two magnetic pole faces with a saturating magnetic field of 2,000 Gauss, such that the induced magnetic field is perpendicular to one of the 1×4 centimeter faces of the cell. The sample is removed from the saturating magnetic field, and the remanence is measured perpendicular to the above 1 centimeter wide face using a Hall-Effect device or a gaussmeter, such as the F.W. Bell, Inc. Model 615 gaussmeter.

In embodiments there is disclosed a process of preparing a low melt MICR toner, whose fusing temperature is in the range of 140° C. to about 170° C. by selecting a vinyl CPE resin latex, a crosslinked vinyl resin latex, a noncrosslinked vinyl resin shell latex together with magnetite, wax and carbon black, and wherein in the magnetite is present in the amount range of from about 20 to about 30 percent by weight of toner, the wax is present in the amount range of about 7 to about 15 percent by weight of toner, and the carbon black is present in the amount range of 3 to about 6 percent by weight of toner, and wherein the three latex resins are selected, for example, in the ratio of 39:5:18 weight percent of V-CPE, crosslinked gel, vinyl resin, respectively, by weight of toner percent, which latexes can be prepared by emulsion polymerization; polysty/Ba/Beta CEA/CPE, polysty/BD/CEA/CPE, polysty/isoprene/CEA/CPE by emulsion polymerization and crystalline resin examples are poly(ethylene-adipate), poly(ethylene-sebacate), poly(butylene-adipate), poly(butylene-sebacate), or poly(hexylene-sebacate), and the like, reference copending application U.S. Ser. No. (not yet assigned—Attorney Docket No. A3541-US-NP), the disclosure of which is totally incorporated herein by reference.

The resins or polymers selected for the process of the present invention can be prepared by a number of known methods such as, for example, emulsion polymerization, including semicontinuous emulsion polymerization methods, and the monomers utilized in such processes can be selected from, for example, styrene, acrylates, methacrylates, butadiene, isoprene, acrylonitrile; monomers comprised of an A and a B monomer wherein from about 75 to about 95 percent of A and from about 5 to about 25 percent of B is selected, wherein A can be, for example, styrene, and B can be, for example, an acrylate, methacrylate, butadiene, isoprene, or an acrylonitrile; and optionally, acid or basic olefinic monomers, such as acrylic acid, methacrylic acid, beta carboxy ethyl acrylate, acrylamide, methacrylamide, quaternary ammonium halide of dialkyl or trialkyl acrylamides or methacrylamide, vinylpyridine, vinylpyrrolidone, vinyl-N-methylpyridinium chloride and the like; a process wherein the CPE polymer originates from a diol, a sulfoisophthalate, a dodecanedioic acid, a butylisophthalic acid and a tin oxide as catalyst, and wherein the resulting CPE polymer is dissolved into styrene monomer, followed by polymerization with butylacrylate beta carboxy ethyl acrylate to provide a latex comprising vinyl-CPE resin particles. The presence of acid or basic groups in the monomer or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of, for example, from about 0.01 micron to about 1 micron in diameter can be selected like polymer microsuspension process, such as those illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes; and toner processes wherein the resin possesses a crosslinking percentage of from about 1 to about 50 or from about 1.5 to about 30.

Colorants include dyes, pigments, and mixtures thereof, colorant examples being illustrated in a number of the copending applications referenced herein, and more specifically, which colorants include known colorants like black, cyan, red, blue, magenta, green, brown, yellow, mixtures thereof, and the like.

Various known colorants, such as pigments, selected for the processes of the present invention and present in the toner in an effective amount of, for example, from about 1 to about 25 percent by weight of toner, and more specifically, in an amount of from about 3 to about 10 percent by weight include, for example, carbon black like REGAL 330®; REGAL 660®; phthalocyanine Pigment Blue 15, Pigment Blue 15.1, Pigment Blue 15.3, and other suitable colorants. Colorants include pigment, dye, mixtures of pigment and dyes, mixtures of pigments, mixtures of dyes, and the like.

Crosslinked resin examples with crosslinking values as illustrated herein, and yet more specifically, of, for example, from about 25 to about 80, and more specifically, from about 30 to about 65 percent, and which resins are selected in various amounts, such as from about 1 to about 20, and more specifically, from about 5 to about 10 weight percent based on the weight percentages of the remaining toner components, include the resins illustrated herein, which resins are crosslinked by known crosslinking compounds, such as divinyl benzene. Specific crosslinked resin examples are poly(styrene divinyl benzene beta CEA), poly(styrene butyl acrylate divinyl benzene beta CEA), poly(styrene divinyl benzene acrylic acid), poly(styrene butyl acrylate divinyl benzene acrylic acid), and the like.

Examples of anionic surfactants that can be selected for the processes illustrated herein include, for example, sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN RK™, NEOGEN SC™ from Kao and the like. An effective concentration of the anionic surfactant generally employed is, for example, from about 0.01 to about 10 percent by weight, and preferably from about 0.1 to about 5 percent by weight of monomers used to prepare the toner polymer resin.

Examples of nonionic surfactants that can be selected for the processes illustrated herein and that may be, for example, included in the resin latex dispersion are, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®. A suitable concentration of the nonionic surfactant is, for example, from about 0.01 to about 10 percent by weight, and more specifically, from about 0.1 to about 5 percent by weight of monomers used to prepare the toner polymer resin.

Examples of cationic surfactants, which are usually positively charged, selected for the toners and processes of the present invention include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ , available from Alkaril Chemical Company, SANIZOL™ (benzalkonium chloride), available from Kao Chemicals, and the like, and mixtures thereof. A suitable amount of cationic surfactant can be selected, such as from about 0.2 to about 5 percent by weight of the toner components.

Examples of silicates that can be selected are sodium silicates, such as those commercially available like A®1647, A®1847, A®2445, A®2447, A®2645, BJ™ 120, BW™ 50, C™, D™, E™, K®, M®, N®, N®38, N® Clear, O®, OW®, RU™, SS® 22, SS® 75, STAR™, STARSO®, STIXSI™ RR, V®, and potassium silicates such as KASIL® 1, KASIL® 6, KASIL® 23, all available from Philadelphia Quartz; sodium silicate Cat. #33,844-3 available from Aldrich Chemicals; OXYCHEM GRADE 40, GRADE 42, GRADE JW-25, GRADE 47, GRADE 49F, GRADE 50, GRADE 52, GRADE WD-43 all available from Occidental Chemical Corporation; KS NO1, NO2, NO3, NO4, SC2, SP2, SB3, G3, SS3 all available from ESEL TechTra Inc., South Korea; sodium silicates available from J. T. Baker, and the like. The silicates in embodiments exhibit a mole ratio of $SiO_2$:$Na_2O$ of about 1.5 to about 3.5, and a mole ratio of $SiO_2$:$Na_2O$ of about 1.8 to about 2.5; a particle size of about 5 to about 80 nanometers, a viscosity at 20° C. and as measured by a Brookfield viscometer of about 20 to about 1,200 centipoises and a density of about 1.25 to about 1.70 gram per $cm^3$.

Counterionic coagulants selected for the processes illustrated herein can be comprised of organic, or inorganic components, and the like. For example, in embodiments the ionic surfactant of the resin latex dispersion can be an anionic surfactant, and the counterionic coagulant can be a polymetal halide or a polymetal sulfosilicate (PASS). Coagulants that can be included in amounts of, for example, from about 0.05 to about 10 weight percent include polymetal halides, polymetal sulfosilicates, monovalent, divalent or multivalent salts, optionally in combination with cationic surfactants, and the like. Inorganic cationic coagulants include, for example, polyaluminum chloride (PAC), polyaluminum sulfosilicate (PASS), aluminum sulfate, zinc sulfate, or magnesium sulfate.

The coagulant is in embodiments present in an aqueous medium in an amount of from, for example, about 0.05 to about 10 percent by weight, and more specifically, in an amount of from about 0.075 percent by weight to about 2 percent by weight. The coagulant may also contain amounts of other components, such as for example nitric acid. The coagulant is usually added slowly while continuously subjecting the mixture resulting to high shear, for example by stirring with a blade at about 3,000 to about 10,000 rpm, and preferably about 5,000 rpm, for about 1 to about 120 minutes. A high shearing device, for example an intense homogenization device, such as the in-line IKA SD-41, may be used to ensure that the coagulant is homogeneous and uniformly dispersed.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-

P™, a low weight average molecular weight polypropylene available from Sanyo Kasei K.K., and similar materials. The commercially available polyethylenes selected possess, it is believed, a molecular weight $M_W$ of from about 500 to about 15,000, while the commercially available polypropylenes are believed to have a molecular weight of from about 3,000 to about 7,000. Examples of functionalized waxes are, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amides, carboxylic acids or acrylic polymer emulsions, for example JONCRYL 74™, 89™, 130™, 537™, and 538™, all available from SC Johnson Wax; chlorinated polypropylenes and polyethylenes available from Allied Chemical and Petrolite Corporation and SC Johnson Wax. The amounts of the wax selected in embodiments is, for example, from about 3.5 to about 15 percent by weight of toner.

The solids content of the resin latexes dispersions are not particularly limited, thus the solids content may be from, for example, about 10 percent to about 90 percent. With regard to the colorants, such as carbon black, in some instances they are available in the wet cake or concentrated form containing water, and can be easily dispersed utilizing a homogenizer or simply by stirring or ball milling, attrition, or media milling. In other instances, pigments are available only in a dry form whereby dispersion in water is effected by microfluidizing using, for example, a M-110 microfluidizer or an ultimizer, and passing the pigments dispersion from about 1 to about 10 times through a chamber by sonication, such as using a Branson 700 sonicator, with a homogenizer, ball milling, attrition, or media milling with the optional addition of dispersing agents such as the aforementioned ionic or nonionic surfactants.

During coalescence, the pH is increased, for example, from about 2 to about 3 to about 7 to about 8; from about 2 to about 2.8 to about 7 to about 7.5 by the addition of a suitable pH agent of, for example, sodium silicate dissolved in sodium hydroxide to provide for the stabilization of the aggregated particles and to prevent/minimize the toners size growth and loss of GSD during further heating, for example, raising the temperature about 10° C. to about 50° C. above the resin Tg. Also, the silicate provides a coating of silica on the magnetite particles thereby lowering the Pzc of the magnetite such that during the coalescence where the pH of the mixture reduced to below about 5 and preferably about 4.5, the fusion of the aggregates can be accomplished by using an acid. Examples of pH reducing agents include, for example, nitric acid, citric acid, sulfuric acid or hydrochloric acid, and the like.

In embodiments, the toner particles formed by processes illustrated herein possess, for example, an average volume diameter of from about 0.5 to about 25, and more specifically, from about 1 to about 10 microns, and narrow-GSD characteristics of, for example, from about 1.05 to about 1.25, or from about 1.15 to about 1.25 as measured by a Coulter Counter. The toner particles also possess an excellent shape factor, for example, of 135 or less wherein the shape factor refers, for example, to the measure of toner smoothness and toner roundness, where a shape factor of about 100 is considered spherical and smooth without any surface protrusions, while a shape factor of about 150 is considered to be rough in surface morphology and the shape is like a potato.

The toner particles illustrated herein may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Specific additives include zinc stearate and AEROSIL R972® available from Degussa Chemical and each present in an amount of from about 0.1 to about 2 percent which can be added during the aggregation process or blended into the formed toner product, calcium stearate and the like.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

The following Examples are provided. Parts and percentages are by weight unless otherwise indicated and temperatures are in degrees Centigrade.

EXAMPLES

Preparation of CPE Resin:

A crystalline linear sulfonated polyester resin comprised of 1 mole of 1,9-nonanediol, 0.02 mole of sodium sulfoisophthalate, 0.905 mole of dodecanedioic acid and 0.075 mole of 5-t-butylisophthalic acid was prepared as follows. Into a two liter Hoppes reactor equipped with a heated bottom drain valve, high viscosity double turbine agitator, and a distillation receiver with a cold water condenser were charged 270 grams of 1,9-nonanediol, 9.98 grams of sodium sulfoisophthalate, 351.12 grams of dodecanedioic acid, 4.62 grams of 5-t-butylisophthalic acid and 0.21 gram of the catalyst dibutytinoxide.

The reactor was heated to 190° C. with stirring for 3 hours. During this stage, the water byproduct from polyesterification was removed via a collective condensation without a vacuum being used. After all the water was removed, the mixture resulting was then heated to 210° C. over a 5 hour period, after which the pressure was slowly reduced from atmospheric pressure to about 50 mmHg over a one hour period, and then reduced to 20 mmHg over a two hour period; subsequently the pressure was then further reduced to about 7 mmHg over a 30 minute period. The polymer resulting was discharged through the heated bottom drain onto a container full of ice water to yield 500 grams of 1 mol percent sulfonated-polyester resin. The resulting sulfonated-polyester resin had a softening point of 93° C. (30 Poise viscosity measured by Cone & Plate Viscometer at 195° C.) and a melting point range of 60° C. to 80° C. as determined by DSC.

Preparation of Vinyl-CPE (V-CPE) Latex (Latex A), Styrene/Acrylate Latex Containing 15 Weight Percent CPE Resin:

A latex emulsion comprised of 15 weight percent of the sulfonated crystalline polyester resin of Example I in styrene/acrylate polymer particles was generated from the emulsion polymerization of styrene, n-butyl acrylate and beta carboxy ethyl acrylate (beta-CEA). The latex comprises 15 weight percent of the sulfonated crystalline polyester resin, 67.1 weight percent of styrene, 17.9 weight percent of n-butyl acrylate and 3 pph of beta CEA.

Into a 500 milliliter round bottom flask were added 81 grams of the above crystalline polyester resin and 300 grams of styrene monomer. Using a stirring bar for agitation, the styrene CPE resin was heated to about 65° C. to about 70° C. using a water bath to dissolve the CPE resin in the styrene monomer. After complete dissolution of the resin, the heat was removed and the solution was cooled to room temperature, about 25° C., without agitation to ensure that the resin did not recrystallize out of solution (solution A).

A surfactant solution of 0.6 gram of DOWFAX 2A1™ (anionic emulsifier) and 514 grams of deionized water were prepared by mixing these components for 10 minutes in a beaker. The resulting surfactant solution was poured into the 2 liter Buchi reactor, and the reactor was then continuously purged with nitrogen while being stirred at 300 RPM. The reactor was then heated to 76° C. at a controlled rate and held constant.

In a separate container, 6.88 grams of ammonium persulfate initiator were dissolved in 45 grams of deionized water. Into a 1 liter metal beaker an emulsified monomer solution (solution B) was prepared by adding 96.4 grams of n-butyl acrylate, 13.77 grams of β-CEA, 7.07 grams of 1-dodecanethiol, 1.61 grams of 1,10-decanediol diacrylate, 257 grams of deionized water and 10.89 grams of DOWFAX 2A1™ surfactant. Using the IKA polytron, the monomer and aqueous surfactant solution was emulsified at 4,000 rpm to which solution A containing the dissolved CPE in styrene was slowly added, while an additional 62.6 grams of styrene were used to rinse out the round bottom flask containing the dissolved CPE in styrene. The emulsification was continued for an additional 3 minutes to produce a stable emulsified monomer/CPE dispersion (solution C). One percent (8.3 grams) of the emulsified monomer/CPE solution (solution C) was slowly fed into the reactor containing the aqueous surfactant phase at 76° C. to form the "seeds" of the latex while being purged with nitrogen. The initiator solution was then slowly charged into the reactor, and after 20 minutes the remainder of the emulsified monomer/CPE mixture (solution C) was continuously fed in using a metering pump at a rate of 4 grams per minutes. Once all the monomer emulsion was charged into the reactor, the reactor temperature was held at 76° C. for an additional 4 hours to complete the reaction. The reactor was cooled down to room temperature. The product was discharged and filtered through a 150 micron screen. The average particle size of the latex as measured by NICOMP particle sizer was 194.4 nanometers, and the solids content of the latex was 40 percent. The latex contained 15 weight percent of the above sulfonated crystalline polyester resin, 67.1 weight percent of styrene, and 17.9 weight percent n-butyl acrylate, and 3 pph of beta CEA. The polymeric resin contained 15 percent of crystalline polyester and 85 percent of the above amorphorous styrene/acrylate polymer.

Preparation of V-CPE Latex (Latex B), Styrene/Acrylate Latex Containing 20 Weight Percent CPE Resin:

A latex emulsion comprised of 20 weight percent of a sulfonated crystalline polyester resin in styrene/acrylate polymer particles generated from the emulsion polymerization of styrene, n-butyl acrylate and beta carboxy ethyl acrylate (beta-CEA). The latex comprised 20 weight percent of sulfonated crystalline polyester resin, 63.2 weight percent of styrene, and 16.8 weight percent of n-butyl acrylate and 3 pph of beta CEA.

Into a 500 milliliter round bottom flask were added 108 grams of the above crystalline polyester resin and 300 grams of styrene monomer. Using a stirring bar for agitation, the styrene/CPE resin was heated to about 65° C. to about 70° C. using a water bath to dissolve the CPE resin in the styrene monomer. After complete-dissolution of the resin, the heat was removed and the solution was cooled to room temperature, about 25° C., without agitation to ensure that the resin did not recrystallize out of solution (solution A).

A surfactant solution of 0.6 gram of DOWFAX 2A1™ (anionic emulsifier) and 514 grams of deionized water was prepared by mixing for 10 minutes in a beaker. The surfactant solution was poured into the 2 liter Buchi reactor, and the reactor was then continuously purged with nitrogen while being stirred at 300 RPM. The reactor was then heated up to 76° C. at a controlled rate and held constant.

In a separate container, 6.48 grams of ammonium persulfate initiator were dissolved in 45 grams of deionized water. Into a 1 liter metal beaker the emulsified monomer solution (solution B) was prepared by adding 90.7 grams of n-butyl acrylate, 12.96 grams of β-CEA, 6.65 grams of 1-dodecanethiol, 1.51 grams of 1,10-decanediol diacrylate, 257 grams of deionized water and 10.89 grams of DOWFAX 2A1™ surfactant. Using the IKA polytron, the monomer and aqueous surfactant solution was emulsified at 4,000 rpm to which solution A containing the dissolved CPE in styrene was slowly added while an additional 41.3 grams of styrene were used to rinse out the round bottom flask containing the dissolved CPE in styrene. The emulsification was continued for an additional 3 minutes to produce a stable emulsified monomer/CPE dispersion (solution C). One percent (8.3 grams) of the emulsified monomer/CPE solution (solution C) was slowly fed into the reactor containing the aqueous surfactant phase at 76° C. to form the "seeds" of the latex while being purged with nitrogen. The initiator solution was then slowly charged into the reactor and after 20 minutes the remainder of the emulsified monomer/CPE mixture (solution C) was continuously fed in using a metering pump at a rate of 4 grams per minute. Once all the monomer emulsion was charged into the reactor, the reactor temperature was held at 76° C. for an additional 4 hours to complete the reaction. The reactor was cooled down to room temperature. The product was discharged and filtered through a 150 micron screen. The average particle size of the latex as measured by NICOMP particle sizer was 194.4 nanometers, and the solids content of the latex was 40 percent. The latex contained 20 weight percent of the above sulfonated crystalline polyester resin, 63.2 weight percent of styrene, 16.8 weight percent of n-butyl acrylate, and 3 pph of beta CEA. The polymeric resin contained 20 percent of crystalline polyester and 80 percent of the above amorphorous styrene acrylate beta CEA polymer.

Preparation of Noncrosslinked Latex C:

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2A1™ (anionic emulsifier –55 percent active ingredients) and 387 kilograms of deionized water was prepared by mixing these components for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of beta-CEA, 7.3 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the aqueous surfactant phase at 80° C. to form seeds wherein "seeds" refer, for example, to the initial emulsion latex added to the reactor prior to the addition of the initiator solution, while being purged with nitrogen. The above initiator solution was then slowly charged into the reactor forming about 5 to about 12 nanometers of latex "seed" particles. After 10 minutes, the remainder of the emulsion was continuously fed using metering pumps.

After the above monomer emulsion was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron average volume diameter resin particles of styrene/butylacrylate/beta CEA suspended in an aqueous phase containing the above surfactant. The molecular properties resulting for the resin latex were $M_W$ (weight average molecular weight) of 35,000, $M_n$ of 10,600 as measured by a Gel Permeation Chromatograph, and a midpoint Tg of 55.8° C. as measured by a Differential Scanning Calorimeter, where the midpoint Tg is the halfway point between the onset and the offset Tg (resin glass transition temperature) of the noncrosslinked shell resin latex polymer.

Preparation of the Crosslinked Latex D (50 nanometers):

A crosslinked latex emulsion comprised of polymer particles generated from the emulsion polymerization of styrene, butyl acrylate and beta carboxy ethyl acrylate (β) CEA was prepared as follows. A surfactant solution of 4.08 kilograms of NEOGEN™ RK (anionic emulsifier) and 78.73 kilograms of deionized water was prepared by mixing these components for 10 minutes in a stainless steel holding tank. The holding tank was then purged with nitrogen for 5 minutes before transferring the resulting mixture into the above reactor. The reactor was then continuously purged with nitrogen while the contents were being stirred at 100 RPM. The reactor was then heated up to 76° C., and held there for a period of 1 hour.

Separately, 1.24 kilograms of ammonium persulfate initiator were dissolved in 13.12 kilograms of deionized water.

Also separately, a monomer emulsion was prepared in the following manner. 47.39 Kilograms of styrene, 25.52 kilograms of butyl acrylate, 2.19 kilograms of β-CEA, 0.729 kilogram of divinyl benzene (DVB) crosslinking agent, 1.75 kilograms of NEOGEN™ RK (anionic surfactant), and 145.8 kilograms of deionized water were mixed to form an emulsion. One (1) percent of the emulsion was then slowly fed into the reactor, while the reactor was being purged with nitrogen, containing the aqueous surfactant phase at 76° C. to form "seeds". The initiator solution was then slowly charged into the reactor, and after 40 minutes the remainder of the emulsion was continuously fed in using metering pumps over a period of 3 hours.

Once all the monomer emulsion was charged into the above main reactor, the temperature was held at 76° C. for an additional 4 hours to complete the reaction. Cooling was then accomplished and the reactor temperature was reduced to 35° C. The product was collected into a holding tank. After drying, the resin latex onset Tg was 53.5° C. The resulting latex was comprised of 25 percent crosslinked resin, 72.5 percent water and 2.5 percent anionic surfactant. The resin had a ratio of 65:35:3 pph:1 pph of styrene:butyl acrylate:β-CEA:DVB. The mean particle size of the gel latex was 50 nanometers as measured on disc centrifuge, and the resin in the latex possessed a crosslinking value of 25 percent as measured by gravimetric method.

Wax and Pigment Dispersions:

The aqueous wax dispersion utilized in the following Examples was generated using (1) P850 wax with a molecular weight, $M_W$ of 850 and a melting point of 107° C. and NEOGEN RK™ as an anionic surfactant/dispersant. The wax is available from Baker-Petrolite. The wax particle size was determined to be approximately 200 nanometers, and the wax slurry was supplied with a solid loading of 30 percent.

The pigment dispersion utilized was an aqueous dispersion of carbon black (REGAL 330®) pigment supplied from Sun Chemicals. The pigment dispersion contained an anionic surfactant, and the pigment content of the dispersion supplied was 19 percent with 2 percent surfactant, and 79 percent water.

Toner Example I

Preparation of V-CPE MICR Toner (15 Percent CPE):

75 Grams of MAGNOX B2550™ acicular magnetite comprised of 21 percent of FeO and 79 percent of $Fe_2O_3$ having a particle size of about 0.6 micron×0.1 micron were added to 600 grams of water containing 1.3 grams of a 20 percent aqueous anionic surfactant (NEOGEN RK™) to which were added 288.2 grams of the above generated vinyl CPE latex (A), and 64 grams of the crosslinked latex (D) of styrene/butylacrylate/divinyl benzene beta CEA (25 percent solids). To the mixture were added 90 grams of a dispersion of submicron polyethylene P 850 wax particles (30 percent solids) and 86 grams of a 17 percent carbon black dispersion, while being polytroned at a speed of 5,000 rpm for a period of 5 minutes. 300 Grams of water were added to reduce the viscosity of the resulting blend to which then was added an aqueous PAC solution comprised of 3 grams of 10 percent solids placed in 23 grams of 0.1M nitric acid.

The resulting blend was then heated to a temperature of 45° C. while stirring for a period of 4 hours to obtain a particle size of 6 microns with a GSD of 1.21. To this was added 133 grams of the above noncrosslinked latex (Latex C) to the aggregate mixture and stirred overnight, about 18 to about 21 hours, at 45° C. to provide a particle size of 6.6 microns and a GSD of 1.20. The aggregate mixture was then stabilized from further growth by changing the pH of the mixture from about 2.6 to about 7 with a 15 gram aqueous solution of sodium silicate containing 27 percent solids in 15 grams of a 4 percent aqueous NaOH solution. This was added to the reaction mixture to which was added an additional 4 percent NaOH to arrive at a pH of 7. The resulting mixture was then heated to 93° C. and the pH was allowed to drift to 6. After 2 minutes at 93° C., the particle size was 6.9 microns with a GSD of 1.19. After 30 minutes the pH was then reduced to 4.7 with a 4 percent aqueous nitric acid solution, and allowed to further coalesce providing a particle size of 7 micron with a GSD of 1.21. The pH was further reduced to 4.35 by adding to the mixture a 4 percent nitric acid solution, and the particles formed were allowed to coalesce for 7 hours at 93° C. resulting in particle size of 7.2 and a GSD of 1.23. The resultant mixture was cooled and the toner obtained was washed 4 times with water and dried on the freeze dryer. The resulting toner was comprised of 25 percent (percent by weight) magnetite, 39 percent of the above vinyl CPE resin, 18 percent of the above noncrosslinked styrene acrylate, beta CEA, 5 percent of the above crosslinked resin, 4.5 percent of carbon black and 8.5 percent of Polywax 850.

Toner Example II

Preparation of V-CPE MICR Toner (20 Percent CPE):

75 Grams of MAGNOX B2550™ acicular magnetite composed of 21 percent of FeO and 79 percent of $Fe_2O_3$ having a particle size of about 0.6 micron×0.1 micron were added to 600 grams of water containing 1.3 grams of 20 percent aqueous anionic surfactant (NEOGEN RK™) to which were added 288.2 grams of vinyl CPE Latex (B), and 64 grams of the crosslinked Latex (D) of styrene/butylacrylate/divinyl benzene beta CEA (25 percent solids). To the mixture were added 90 grams dispersion of submicron polyethylene P 850 wax particles (30 percent solids), and 86 grams of 17 percent carbon black dispersion, while being polytroned at a speed of 5,000 rpm for a period of 5 minutes. 300 Grams of water were added to reduce the viscosity of the resulting blend to which then was added an aqueous PAC solution comprised of 3 grams of 10 percent solids placed in 23 grams of 0.1M nitric acid.

The resulting blend was then heated to a temperature of 45° C. while stirring for a period of 4 hours to obtain a particle size of 6.3 microns with a GSD of 1.22. 133 Grams of the above noncrosslinked latex (Latex C) were then added to the aggregate mixture and stirred overnight, about 18 hours, at 45° C. to provide a particle size of 6.6 microns and a GSD of 1.20. The aggregate mixture was then stabilized from further growth by changing the pH of the mixture from about 2.6 to about 7 with a 15 gram aqueous solution of sodium silicate containing 27 percent solids and was placed in 15 grams of a 4 percent aqueous NaOH (sodium hydroxide) solution. There was then added to the reaction mixture additional 4 percent NaOH to arrive at a pH of 7. The mixture was then heated to 93° C. and the pH was allowed to drift to 6. After 2 minutes at 93° C., particle size measure was 6.9 microns with a GSD of 1.19. After 30 minutes, the pH was then reduced to 4.7 with a 4 percent aqueous nitric acid solution and allowed to further coalesce providing a particle size of 7.1 microns with a GSD of 1.21. The pH was further reduced to 4.35 by adding a 4 percent nitric acid solution, and the particles formed were allowed to coalesce for 7 hours at 93° C. resulting in particle size of 7.2 and a GSD of 1.23. The resultant mixture was cooled and the toner obtained was washed 4 times with water and dried on the freeze dryer. The resulting toner was comprised of a core of 25 percent of magnetite, 39 percent of vinyl CPE resin, 5 percent of the above crosslinked resin, 4.5 percent of carbon black and 8.5 percent of POLYWAX 850™, and a shell of 18 percent of the above noncrosslinked styrene acrylate, beta CEA. The thickness of the shell was about 0.2 to about 0.5 micron.

Example III

Comparative Toner (No Vinyl-CPE):

A control toner was prepared in a similar manner as that of Example I, except that the vinyl—CPE Latex (A) was replaced with latex (C). All the processing conditions were substantially identical to that of Example I, and the final particle size of the toner obtained was 7.2 microns (volume average diameter) with a GSD of 1.22. The resulting toner was comprised of 25 percent magnetite, 57 percent of the above noncrosslinked styrene acrylate, beta CEA, 5 percent of the above crosslinked resin, 4.5 percent of carbon black and 8.5 percent of POLYWAX 850™.

MICR toners containing vinyl CPE as part of the toner formulation when fused on the Xerox Corporation 5090 fuser showed a reduction in the minimum fixing temperatures of about 15° C. to about 30° C. as compared to the-above control toner containing no vinyl-CPE resin in the formulation. An advantage of the MFT reduction allowed a copying/printing speed increase in a xerographic apparatus, such as the Xerox Corporation 5090, extending the fuser roll and the photoreceptor life by a factor of 25 percent.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A toner process comprised of a first heating of a mixture of an acicular magnetite dispersion, a colorant dispersion, a wax dispersion, and a core latex comprised of a first latex containing a vinyl crystalline polyester resin substantially free of crosslinking, and wherein said polyester is substantially dissolved in a vinyl monomer and polymerized to provide said first core latex resin, and which mixture contains a second crosslinked resin containing latex wherein said heating is accomplished in the presence of a coagulant to provide aggregates; adding a shell latex comprised of a polymer substantially free of crosslinking, and further heating said aggregates to provide coalesced toner particles, and wherein said further heating is at a higher temperature than said first heating.

2. A process in accordance with claim 1 wherein said aggregates are mixed with an organic complexing compound or a silicate salt and a base.

3. A process in accordance with claim 2 wherein said silica is incorporated in said toner by an in situ method, wherein said silica is obtained from said silicate, and wherein said silicate is selected in an amount of from about 0.5 to about 5 percent by weight of toner.

4. A process in accordance with claim 1 comprising (i) heating said acicular magnetite dispersion containing water and an anionic surfactant, and said colorant dispersion containing carbon black, water, and an anionic surfactant, and optionally a nonionic surfactant, and wherein said wax dispersion is comprised of submicron wax particles of from about 0.1 to about 0.5 micron in diameter by volume, and which wax is dispersed in water and contains an anionic surfactant to provide a mixture containing magnetite, colorant, and a wax;

(ii) and wherein the resulting mixture is blended with said core latexes, said first latex comprising submicron noncrosslinked resin particles of about 150 to about 300 nanometers in diameter containing water, and an anionic surfactant or a nonionic surfactant, and wherein said second latex comprises submicron crosslinked resin particles of about 30 to about 150 nanometers in diameter and present in an amount of from about 10 to about 25 percent by weight, and containing water and an anionic surfactant or a nonionic surfactant; and said third latex is comprised of a vinyl copolymer;

(iii) wherein the resulting blend of (ii) possesses a pH of about 2.2 to about 2.8, and to which is added a coagulant to initiate flocculation or aggregation of said resulting components;

(iv) heating the resulting mixture of (iii) below about the glass transition temperature (Tg) of the vinyl crystalline resin to form aggregates;

(v) adding to the formed aggregates said third latex suspended in an aqueous phase containing an ionic surfactant and water;

(vi) adding to the resulting mixture of (v) an aqueous solution of a silicate salt dissolved in a base to thereby change the pH, which is initially from about 2 to about 2.8, to arrive at a pH of from about 7 to about 7.4 resulting in a coating of silica on the aggregate particles containing magnetite;

(vii) heating the resulting mixture of (vi) above the Tg of the vinyl crystalline polyester resin copolymer, and allowing the pH to decrease;

(viii) optionally retaining the mixture of (vii) at a temperature of from about 85° C. to about 95° C. for an optional period of about 10 to about 60 minutes, followed by a pH reduction with an acid to arrive at a pH of from about 4.2 to about 4.8, which pH is below about the Pzc of the magnetite particles wherein the Pzc is the pH of the mixture particles when said particles are free of a positive or a negative charge, and optionally wherein an increase in temperature results in a decreased Pzc value;

(ix) retaining the mixture temperature at from about 85° C. to about 95° C. for an optional period of about 5 to about 10 hours to assist in permitting the fusion or coalescence of the toner aggregates and to obtain smooth particles;

(x) washing the resulting toner slurry;

(xi) isolating the formed toner particles, and drying; and wherein said toner possesses a low melting temperature of from about 140° C. to about 170° C.

5. A process in accordance with claim 4 wherein said silicate salt dissolved in said base is introduced at (vi).

6. A process in accordance with claim 4 wherein said silicate reacts with said magnetite rendering said magnetites substantially insensitive to pH fluctuations and resulting in the magnetite Point of Zero Charge (Pzc) being substantially ineffective.

7. A process in accordance with claim 4 wherein the Pzc of said magnetite is altered by said silica, which silica is present as a coating on said magnetite, and wherein said silica is obtained from said silicate, and wherein said silicate is a sodium silicate, a potassium silicate, or a magnesium silicate sulfate, and said coagulant is a polymetal halide.

8. A process in accordance with claim 4 (viii) wherein said pH is decreased to about 4.5, said pH being lower than that of said magnetite which is at a pH of about 5.3.

9. A process in accordance with claim 4 wherein said silicate and said base are respectfully sodium silicate dissolved in sodium hydroxide, or potassium silicate ($K_2O/SiO_2$) dissolved in potassium hydroxide.

10. A process in accordance with claim 4 wherein said silicate is sodium silicate, thereby forming $SiO_2$:$Na_2O$ with a weight ratio of about 1.6 to about 3.2.

11. A process in accordance with claim 1 wherein said coagulant is selected from the group consisting of polyaluminum chloride (PAC), polyaluminum sulfosilicate (PASS), aluminum sulfate, zinc sulfate, and magnesium sulfate.

12. A process in accordance with claim 1 wherein said colorant is carbon black, and optionally wherein said carbon black dispersion comprises carbon black particles of from about 0.01 to about 0.2 micron diameter dispersed in water and an anionic surfactant, and wherein said colorant is present in an amount of from about 4 to about 12 weight percent.

13. A process in accordance with claim 1 wherein the amount of acicular magnetite selected is from about 20 to about 40 percent by weight of toner, said colorant is carbon black present in an amount of from about 4 to about 8 percent by weight of toner, and said wax is present in the amount of about 4 to about 12 percent by weight of toner; said crosslinked resin is present in the amount of about 5 to about 10 percent by weight; the resin free of crosslinking is present in an amount of about 30 to about 50 percent by weight of toner; said vinyl crystalline polyester resin is selected in an amount of from about 10 to about 20 percent by weight of toner; and said coagulant is comprised of polymetal halide present in an amount of about 0.02 to about 2 percent by weight of toner.

14. A process in accordance with claim 1 wherein said acicular magnetite is from about 0.6 to about 0.1 micron in average volume diameter and is selected in an amount of from about 23 to about 35 percent by weight of toner, and wherein said coagulant is a polymetal halide selected in an amount of about 0.05 to about 0.15 percent by weight of toner.

15. A process in accordance with claim 1 wherein said acicular magnetite possesses a coercivity of from about 250 to about 500 Oe, a remanent magnetization (Br) of about 23 to about 39 emu/gram, and a saturation magnetization (Bm) of about 70 to about 90 emu/gram, and wherein said toner exhibits a magnetic signal of about 90 to about 150 percent of the nominal where the nominal is a signal strength of about 100 percent.

16. A process in accordance with claim 1 wherein the crosslinked resin contains particles of from about 0.15 to about 0.4 micron in volume average diameter, and said resin free of crosslinking is of a diameter of from about 0.15 to about 0.5 micron, and said third resin latex resin is of a volume average diameter of from about 0.15 to about 0.5 micron.

17. A process in accordance with claim 4 wherein said acid is nitric, sulfuric, hydrochloric, citric or acetic acid, and said coagulant is a polyaluminum chloride wherein said shell is of a thickness of about 0.2 to about 0.8 micron, and optionally wherein said coagulant is a polymetal halide, and wherein the pH of the mixture resulting in (vi) is increased from about 2 to about 2.6 to about 7 to about 7.5, and wherein said silicate salt dissolved in a base functions primarily as a stabilizer for the aggregates during coalescence (vii), and no or minimal toner particle size increase results, and wherein said coagulant is a polymetal halide, and wherein the aggregation (iv) temperature is from about 45° C. to about 60° C., and wherein the coalescence or fusion temperature of (vii) and (viii) is from about 80° C. to about 95° C., and wherein said coagulant is a polyaluminum halide; and optionally, wherein the time of coalescence or fusion is from about 6 to about 12 hours.

18. A process in accordance with claim 1 wherein said first latex resin is selected from the group comprised of copoly(styrene-alkyl acrylate crystalline polyester), or a copoly(styrene-1,3-diene crystalline polyester); said second latex resin is comprised of a crosslinked vinyl polymer; and said noncrosslinked resin is poly(styrene-alkyl methacrylate), poly(alkyl methacrylate-alkyl acrylate), poly (alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly (styrene-propyl acrylate), poly(styrene-butyl acrylate), poly (styrene-butadiene-acrylonitrile), and poly(styrene-butyl acrylate-acrylononitrile), or mixtures thereof.

19. A process in accordance with claim 1 wherein said core polyester is comprised of a linear sulfonated polyester wherein said wax dispersion contains a polyethylene wax, a polypropylene wax or mixtures thereof, water, and an anionic surfactant; and wherein said wax is selected in an amount of from about 5 to about 20 weight percent wherein said vinyl crystalline polyester and said shell latex resin are free of crosslinking, and wherein said crosslinked resin is present in an amount of from about 2 to about 25 weight percent; and wherein said crosslinked resin possesses a molecular weight Mw of from about 100,000 to about 1,000,000, and an onset glass transition (Tg) temperature of about 48° C. to about 58° C.

20. A process in accordance with claim 1 wherein said crosslinked resin is poly(styrene butylacrylate, beta carboxy ethyl acrylate divinyl benzene) wherein said shell resin free of crosslinking possesses a molecular weight Mw of about 20,000 to about 500,000, and an onset glass transition (Tg) temperature of from about 45° C. to about 55° C. and wherein said polyester polymer is of a Mw of from about 30,000 to about 40,000, and a $M_n$ of from about 9,000 to about 13,000, and wherein said core contains said polyester formed by the polymerization of a crystalline polyester and a vinyl monomer.

21. A process comprised of a first heating of a mixture of an acicular magnetite dispersion, a colorant dispersion, and a core comprised of a first latex comprised of a vinyl crystalline polyester copolymer, and a second latex containing a crosslinked resin in the presence of a coagulant; heating below the Tg of the first latex resin to provide aggregates; adding a shell latex comprised of a vinyl polymer free of crosslinking; adding a silicate salt dissolved in a base; and further heating at a temperature higher than said first heating to provide coalesced toner particles.

22. A process in accordance with claim 1 wherein said vinyl core monomer is selected from the group comprised of styrene, butyl acrylate beta CEA styrene, butyl acrylate acrylic acid resin, styrene, butyl acrylate itaconic acid resin, styrene, butadiene acrylic acid resin, styrene, butadiene itaconic acid resin, and styrene, butadiene beta CEA resin, and wherein said crystalline polyester is a sulfonated polyester.

23. A process in accordance with claim 2 wherein said organic complexing compound is selected in an amount of about 0.2 to about 5 pph by weight of toner, and is selected from the group consisting of ethylene diamine tetra acetic acid (EDTA), gluconal, sodium gluconate, potassium citrate, sodium citrate, a nitrotriacetate (NTA) salt, GLDA, the product of glutamic acid and N,N-diacetic acid; and humic acid, fulvic acid, maltol and ethyl-maltol, peta-acetic and tetra-acetic acids, optionally wherein said silicate and said base are respectfully sodium silicate dissolved in sodium hydroxide, or potassium silicate ($K_2O/SiO_2$) dissolved in potassium hydroxide, and wherein said first latex resin is comprised of copoly(styrene butylacrylate beta carboxy ethylacrylate, crystalline polyester), said second crosslinked resin is comprised of poly(styrene butylacrylate beta carboxy ethylacrylate, divinyl benzene), and said shell is comprised of poly(styrene butylacrylate beta carboxy ethylacrylate).

24. A process in accordance with claim 1 wherein said colorant is carbon black, said wax is an alkylene, and said coagulant is a polymetal halide.

* * * * *